US005946805A

United States Patent [19]

Oldroyd

[11] Patent Number: 5,946,805

[45] **Date of Patent: *Sep. 7, 1999**

[54] SHAVING SYSTEM

[75] Inventor: Brian Oldroyd, Reading, United Kingdom

[73] Assignee: The Gillette Company, Boston, Mass.

[ * ] Notice: This patent issued on a continued prosecution application filed under 37 CFR 1.53(d), and is subject to the twenty year patent term provisions of 35 U.S.C. 154(a)(2).

[21] Appl. No.: 08/557,199

[22] PCT Filed: Sep. 29, 1994

[86] PCT No.: PCT/US94/11028

§ 371 Date: Jul. 8, 1996

§ 102(e) Date: Jul. 8, 1996

[87] PCT Pub. No.: WO95/09719

PCT Pub. Date: Apr. 13, 1995

[30] Foreign Application Priority Data

Oct. 1, 1993 [GB] United Kingdom ..... 9320283

[51] Int. Cl.[6] ..... B26B 21/24; B65D 83/10

[52] U.S. Cl. ..... 30/40.2; 30/51

[58] Field of Search ..... 30/40.2, 51, 40; 206/356, 359, 228

[56] References Cited

U.S. PATENT DOCUMENTS

| | | | |
|---|---|---|---|
| 3,696,915 | 10/1972 | Douglas | 30/40 |
| 3,833,146 | 9/1974 | Braginetz | 221/66 |
| 3,834,018 | 9/1974 | Dawidowicz et al. | 30/40.2 |
| 3,880,284 | 4/1975 | Pomfret | 30/40.2 |
| 4,043,035 | 8/1977 | Pentney | 30/40.2 |
| 4,140,244 | 2/1979 | Clabby | 221/281 |
| 4,173,285 | 11/1979 | Kiraly et al. | 30/40.2 |
| 4,978,031 | 12/1990 | Lebke | 221/102 |
| 5,240,107 | 8/1993 | Casale | 30/40.2 |
| 5,347,717 | 9/1994 | Ts'ai | 30/89 |
| 5,518,114 | 5/1996 | Kohring et al. | 30/40 |
| 5,636,442 | 6/1997 | Wain | 30/40.2 |
| 5,867,907 | 2/1999 | Terry et al. | 30/40.2 |

FOREIGN PATENT DOCUMENTS

| | | | |
|---|---|---|---|
| 8004939 | 11/1980 | Netherlands | 30/40 |
| 9011875 | 10/1990 | WIPO . | |

*Primary Examiner*—Kenneth E. Peterson
*Attorney, Agent, or Firm*—Ladas & Parry

[57] ABSTRACT

A shaving system comprising a razor handle for detachably mounting a blade unit, and a dispensing container housing a plurality of blade units side by side in a row between entry and exit ends of the container, the handle being arranged to be guided along the container during blade unit replacement for disengaging and leaving the blade initially thereon at the trailing end of the row, and for engaging and withdrawing from the container the leading blade unit, the blade units each having a guide for guiding the razor handle along the container.

10 Claims, 15 Drawing Sheets

13
59
60
65
63
61
15
2
67
11
17
12
10

SHAVING SYSTEM

This invention is concerned with razors and it relates in particular to a shaving system of a kind comprising a razor handle for detachably mounting a blade unit to enable replacement of the blade unit when its blade or blades have become dulled, and a supply of blade units carried in a dispensing container which holds the blade units until they are required for use and which facilitates completion of an operation to replace a blade unit on the handle without need for the person performing the operation having to touch directly either the used blade unit or the replacement blade unit. Shaving systems of this kind are known and the ability to change a blade unit on the handle without having to manipulate the blade units themselves with the fingers of the hand is of considerable advantage from a safety point of view.

It has been proposed to construct the dispensing container so that the blade units are stored side-by-side in a single row between entry and exit ends of the container. By "side-by-side" it is meant the blade units are parallel to each other with the cap of one blade unit adjacent the guard of the next blade unit. In these known dispensers means are provided on the container for guiding the handle along the container so that when the handle is inserted into and moved along the container, the blade unit mounted on the handle displaces the row of blade units forwardly to bring the leading blade unit of the row into a dispensing location, the handle releases the blade unit so that it becomes a trailing blade unit in the row, and the handle is guided past all the blade units except the leading blade unit to which it becomes connected so that the leading blade unit is withdrawn from the exit end of the container in operative engagement with the handle. Such an arrangement is disclosed in WO 90/11875, for example, and it has the attraction that a blade unit replacement operation is completed by a single stroke of the razor handle through the container. Also, it is ensured that used blade units are returned to the container for safe disposal. However, there are some drawbacks. As the container is required to guide the handle and control the latching mechanism by means of which it is connected to a blade unit, the container has a rather complicated form so that manufacturing costs are relatively high.

According to the present invention there is provided a shaving system comprising a razor handle for detachably mounting a blade unit, and a dispensing container housing a plurality of blade units side-by-side in a row between entry and exit ends of the container, the handle being arranged to be guided along the container during blade unit replacement for disengaging and leaving the blade unit initially thereon at the trailing end of the row and for engaging and withdrawing from the container the leading blade unit, wherein means for guiding the razor handle are provided on the blade units.

According to an embodiment of the invention there is provided a dispensing container for holding a row of blade units arranged to be moved in unison along the container to advance the leading blade to a dispensing position, and stop means are provided at the end of the container whereby the leading blade is constrained to be moved upwardly away from the bottom of the container for removal from the container.

The present invention also provides a novel safety razor structure which is particularly suited to the shaving system of the invention as defined above. Thus, there is provided a safety razor including a handle, and a blade unit detachably mounted on the handle by a releasable coupling comprising complementary sliding connection means arranged on the rear of the blade-unit and on the handle for connecting the handle to the blade unit and disconnecting the handle from the blade unit by movement relative thereto in a predetermined forward direction transverse to the length of the blade unit, and releasable latching means on the handle for engaging the blade unit to lock the blade unit to the handle to prevent sliding movement therebetween and thereby to retain the blade unit in a predetermined operative position on the handle.

In a preferred construction the latching means is arranged to be released upon moving the first blade unit mounted on the handle into abutment with a second substantially identical blade unit, whereby the handle is freed for sliding movement out of connection with the first blade unit and into connection with the second blade unit. It will be appreciated that if several blade units are arranged side-by-side in a row, e.g. in a dispensing container, upon bringing a blade unit carried by the handle into abutment with the trailing blade unit in the row, the latching means will be released and allow the handle to slide along the row until it becomes latched to the leading blade unit.

With the previously proposed shaving systems mentioned hereinabove it has been proposed to incorporate a stop member behind the last blade unit in the row of new block units supplied in the dispensing container, and this stop member moves with the blade units along the container. When it reaches a position adjacent the blade unit dispensing location further advancement of the stop member is blocked. In this way the stop member prevents used blade units inserted into the container behind the stop member from being cycled through the container and dispensed again. However, attempt can still be made to effect a blade unit replacement operation as the entry position is vacant. In other words, the user may try to insert a further used blade into a container already filled with used blades, which can be an inconvenience.

In accordance with another aspect, the present invention avoids this drawback of previously proposed dispensers by providing a dispensing container with a means which upon dispensing the final blade unit initially contained causes the entry position to be occupied by the last used blade unit inserted into the container to block the entry position against insertion of a further blade unit.

In an embodiment described in detail herein below, a barrier member which separates new and used blade units and which slides along the container with the blade units, incorporates a spring device which expands in order to drive the barrier member and the following used blade units in the reverse direction towards the entry end. The last used blade unit then occupies the entry position to block insertion of a further blade unit. The spring can be conveniently compressed between the barrier member and end wall of the container upon advancing the last new blade unit into the dispense position.

According to an alternative embodiment the barrier member again separates new and used blade units and slides along the container, but an end stop is provided to limit the forward movement so that when one new blade unit remains in the container displacement of the following used blade units along the container is prevented. When the last used blade unit is inserted it is left occupying the entry position.

Also in accordance with the present invention there is provided a razor handle comprising slide means for engaging complementary means on the rear of a blade unit to enable the handle to be connected to and disconnected from the blade unit by sliding movement relative thereto in a predetermined direction transverse to the length of the blade unit, latch means for engaging the blade unit to retain the blade unit on the handle in operative association therewith, and cam means coupled to the latch means for disengaging the latch means from a blade unit connected to the handle upon the cam means being brought into contact with a further blade unit by movement of the handle in a direction to bring the slide means into cooperation with the complementary slide means of the further blade unit.

Furthermore, the invention also provides a blade unit for releasable attachment to a razor handle, comprising connection means on the rear of the blade unit defining a slideway extending across the blade unit transverse to the length thereof to enable the handle to be connected to and disconnected from the blade unit by sliding movement in a predetermined direction, and recess means for receiving latch means on the handle, to lock the blade units to the handle, the blade unit being positionable in parallel abutment with other substantially identical blade units for the connection means of the abutting blade units to define a slideway extending substantially continuously across the group of the abutting blade units for guiding the handle for sliding movement from the trailing blade unit to the leading blade unit of the group.

A clear understanding of the invention in its different aspects will be gained from the following detailed description of some particular embodiments, reference being made to the accompanying drawings, in which.

Figure 1:
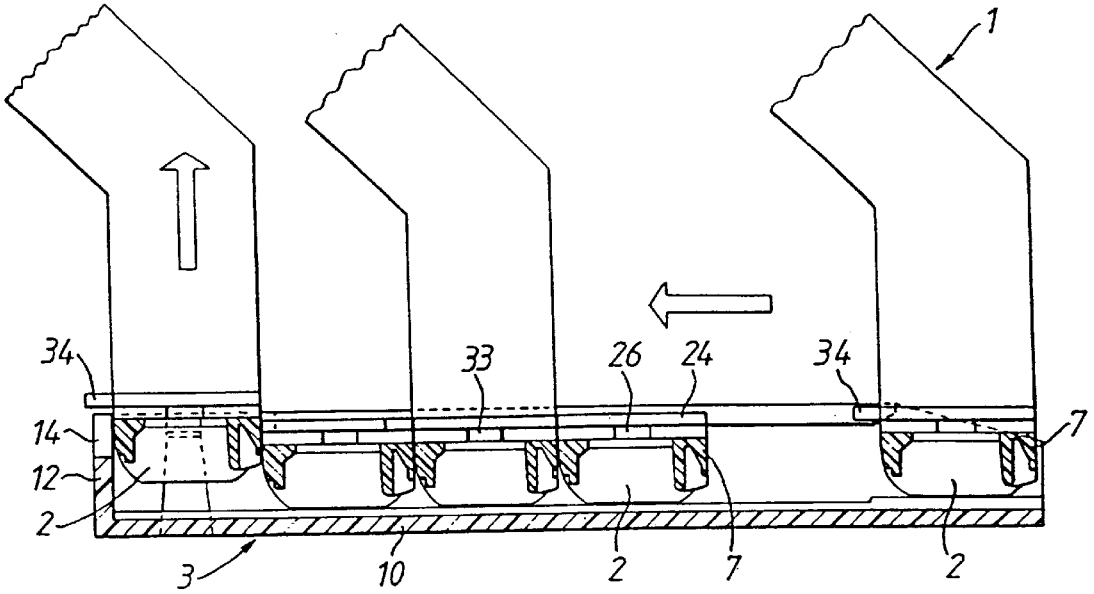
FIG. 1 is a longitudinal cross-section through a dispensing container and illustrating movement there along of a razor handle in a procedure for replacement of a blade unit on the handle.

The essential components of the shaving system illustrated in FIG. 1 are a razor handle 1, a blade unit 2 detachably mountable on the handle to form a complete razor, and a dispensing container 3 for holding a plurality of blade units, the intention being that the blade units should be stored in the container 3 both before and after use on the handle. The razor handle has a blade mounting head 5, shown in FIGS. 5 and 6 and described in detail below, incorporating the coupling mechanism for connecting and disconnecting the blade units. The mounting head may be attached so that the razor will have a fixed blade unit or it could be connected to the stem portion of the handle by a connection enabling the cartridge to pivot about a longitudinal axis parallel to the blade edge during shaving. The blade units which are commonly called and are referred to hereinafter as cartridges, are all essentially identical and with the exception of the particular means for connecting them to the handle, as further described herein below, the cartridges can be of known construction with a moulded frame 7 in which one or more blades are mounted to extend longitudinally of the frame. Provided on the frame and defined either by the frame itself or by separate elements mounted on it, are guard and cap surfaces. As they form no part of the novel aspects of the invention disclosed herein, the blades and the cap and guard elements are not shown in the drawings to facilitate clear illustration of the other cartridge parts.

Figure 2:
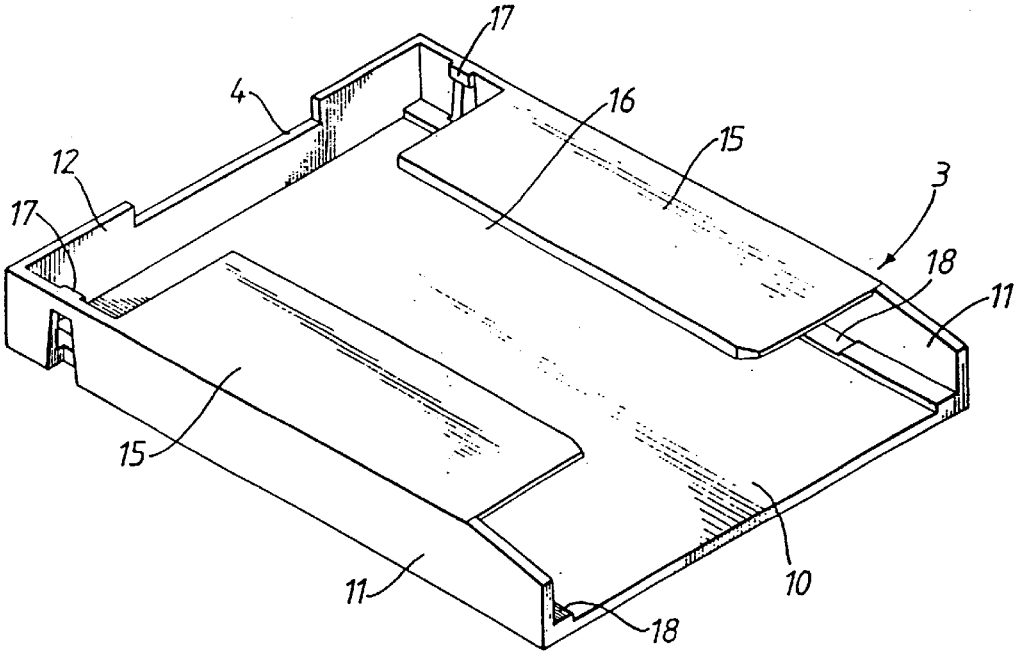
FIG. 2 is a perspective view of the dispensing container, the blade units being omitted.
Figure 9:
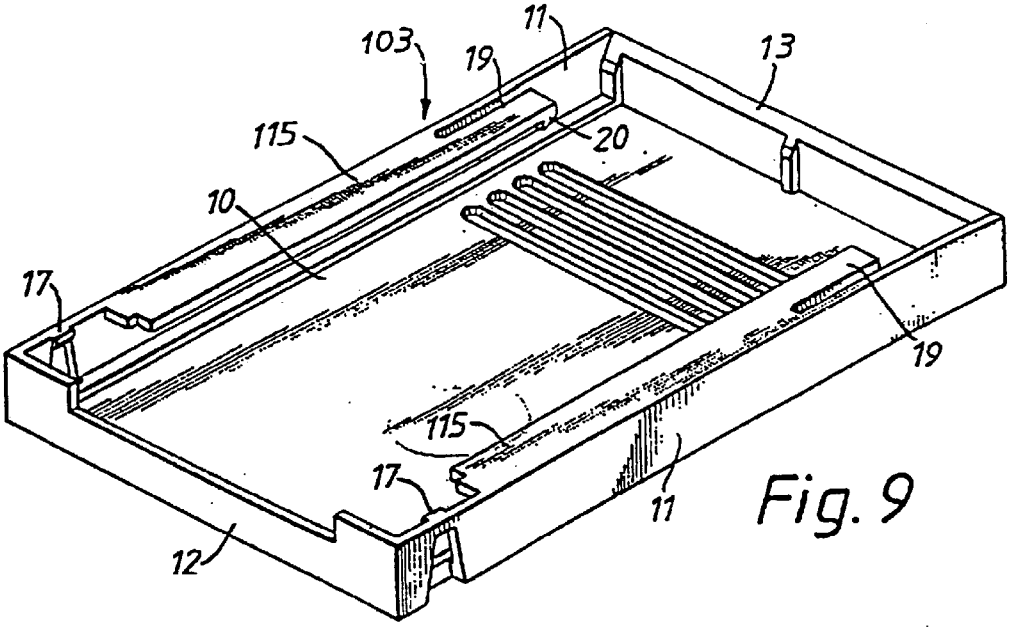
FIG. 9 is a perspective view showing an alternative form of container to that of FIG. 2.

The dispensing container is shaped and configured to hold a row of cartridges arranged side-by-side, i.e. in parallel one behind the other along the container. The container (see FIG. 2) has a bottom wall 10, opposed side walls 11 and an end wall 12 at the exit end of the container. As shown in FIGS. 1 and 2 the other entry end of the container is open to facilitate introduction of a cartridge into an entry position defined at this end of the container. Two cartridge retaining flanges 15 project inwardly towards each other at the upper edges of the side walls for retaining cartridges located in a medial storage section of the container. The opposed edges of the flanges 15 define a slot 16 for passage of the razor handle during cartridge exchange. The flanges terminate short of the end wall 12 to define a cartridge dispensing position from which a cartridge can be lifted out of the container. At this position the side walls are formed with retention protrusions 17 for keeping a cartridge in the container at the dispensing position, but enabling the cartridge to be snapped out of the container by pulling on the razor handle to which it is attached. It is intended that cartridges should move unidirectionally along the container and for this purpose the container is equipped with means to prevent displacement of the cartridges in the reverse direction. As shown in FIG. 2, slide rails 18 formed at the lateral edges of the bottom wall are stepped to form stops for engagement by the trailing cartridge in the row stored beneath the container flanges 15. In the modified container (103) illustrated in FIG. 9 the container flanges 115, which are much narrower than flanges 15 from FIG. 2, have end portions formed as resilient tongues 19 with downwardly directed teeth-like projections 20 at their ends. The tongues can deflect to allow a cartridge to slide under the retaining flanges, but the projections 20 prevent an inserted cartridge from backing out again. Also in this embodiment, end walls 12,13 are provided at both ends, so that a cartridge must be inserted downwardly into the entry position. The number of cartridges to be supplied in the container will determine the container length. The stored cartridges can slide along the container and are arranged in abutment with each other for advancement in unison as a group along the container.

Figure 3:
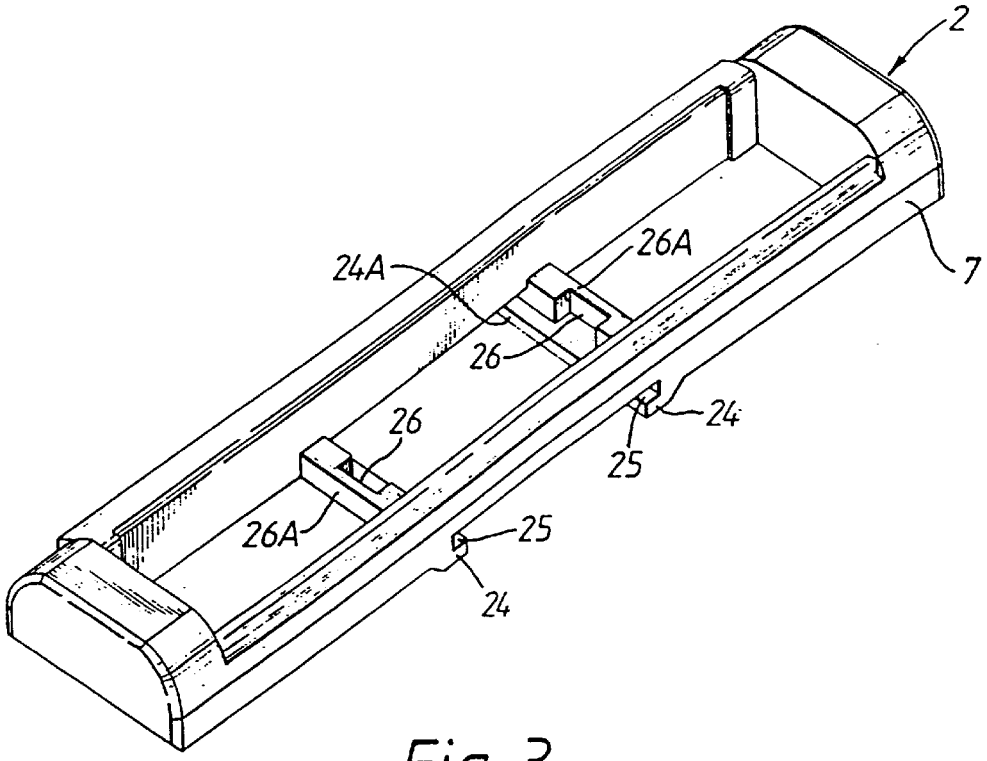
FIGS. 3 and 4 are front and rear perspective views respectively of the blade support frame of a blade unit.
Figure 4:
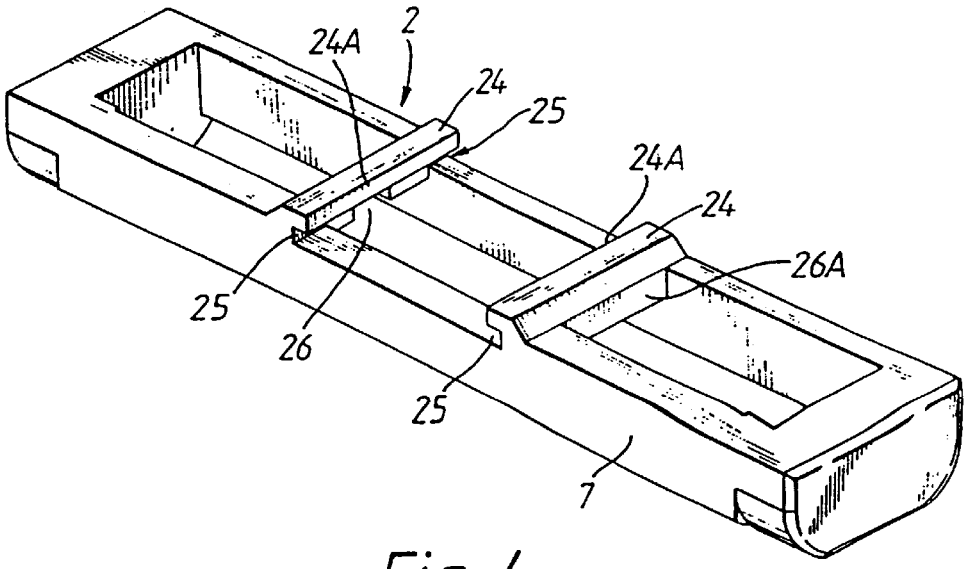
Figure 5A:
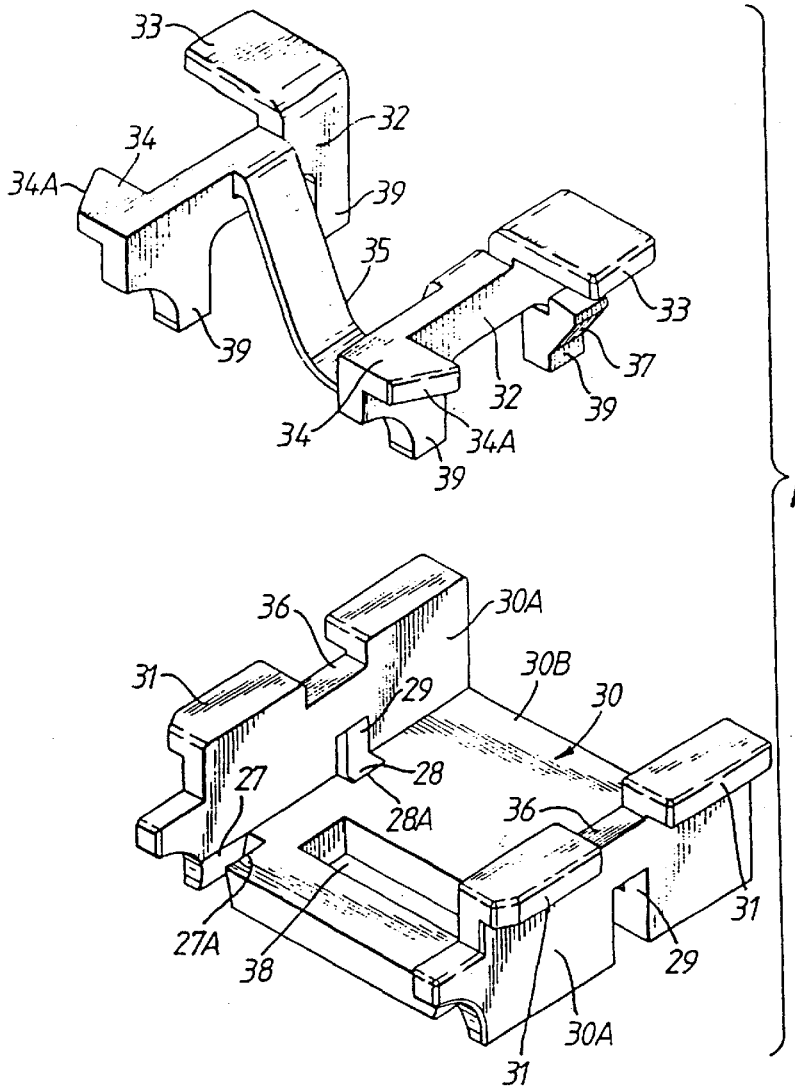
FIG. 5A is an exploded perspective view of the arrangement shown in FIG. 5.
Figure 5:
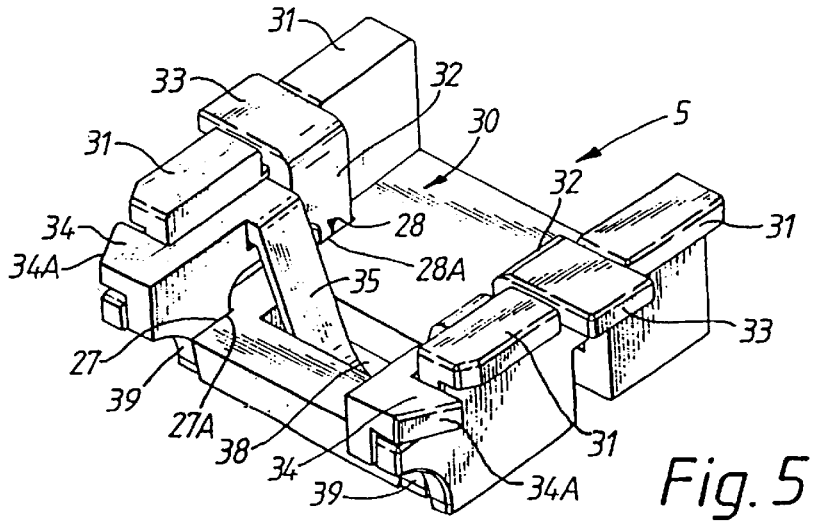
FIG. 5 is a front perspective view of the blade unit coupling arrangement of the razor handle.
Figure 5B:
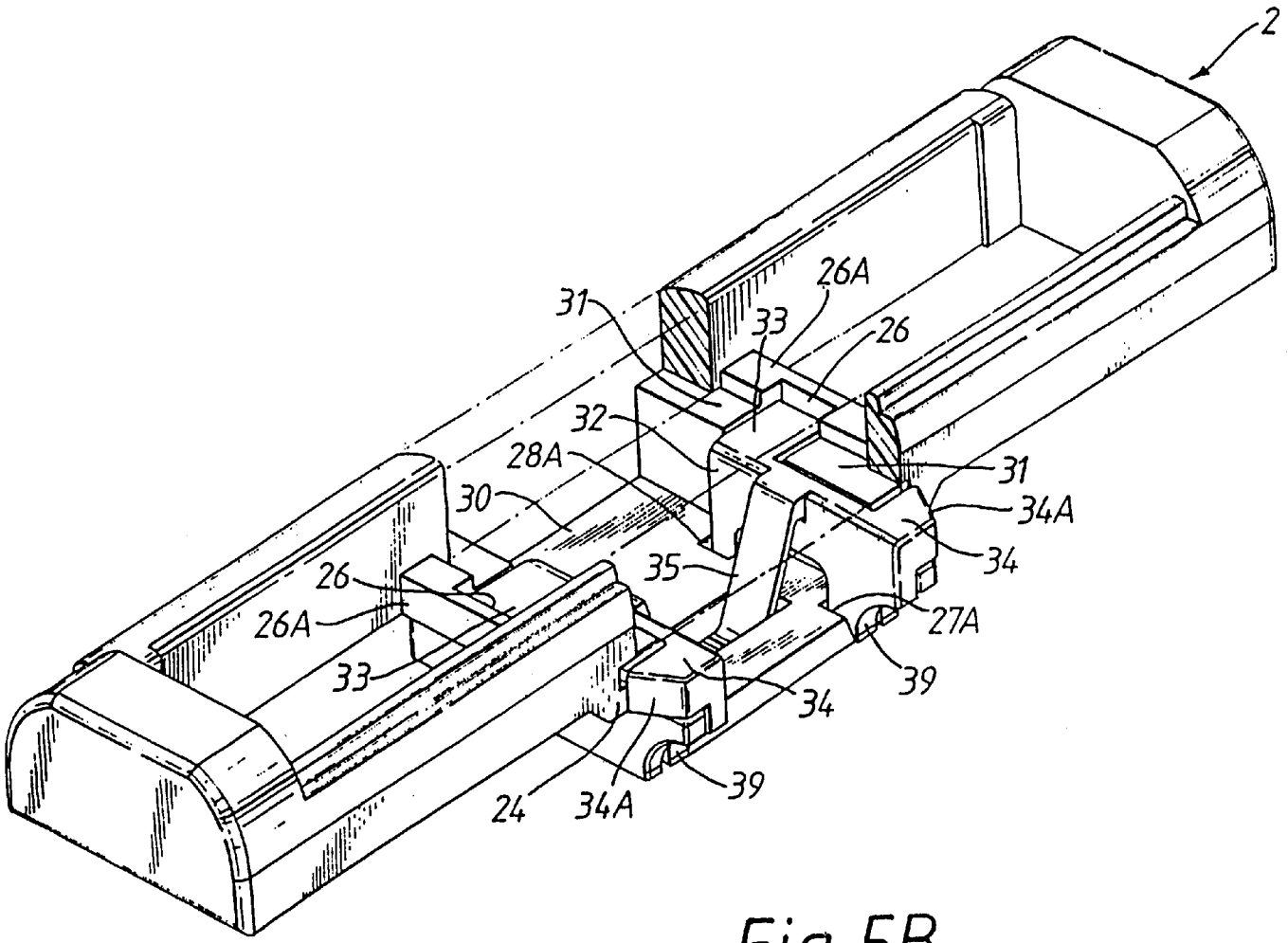
FIG. 5B is a perspective view showing a cartridge attached to the head of a razor handle, the cartridge being shown partly cut away for ease of illustration.
Figure 5C:
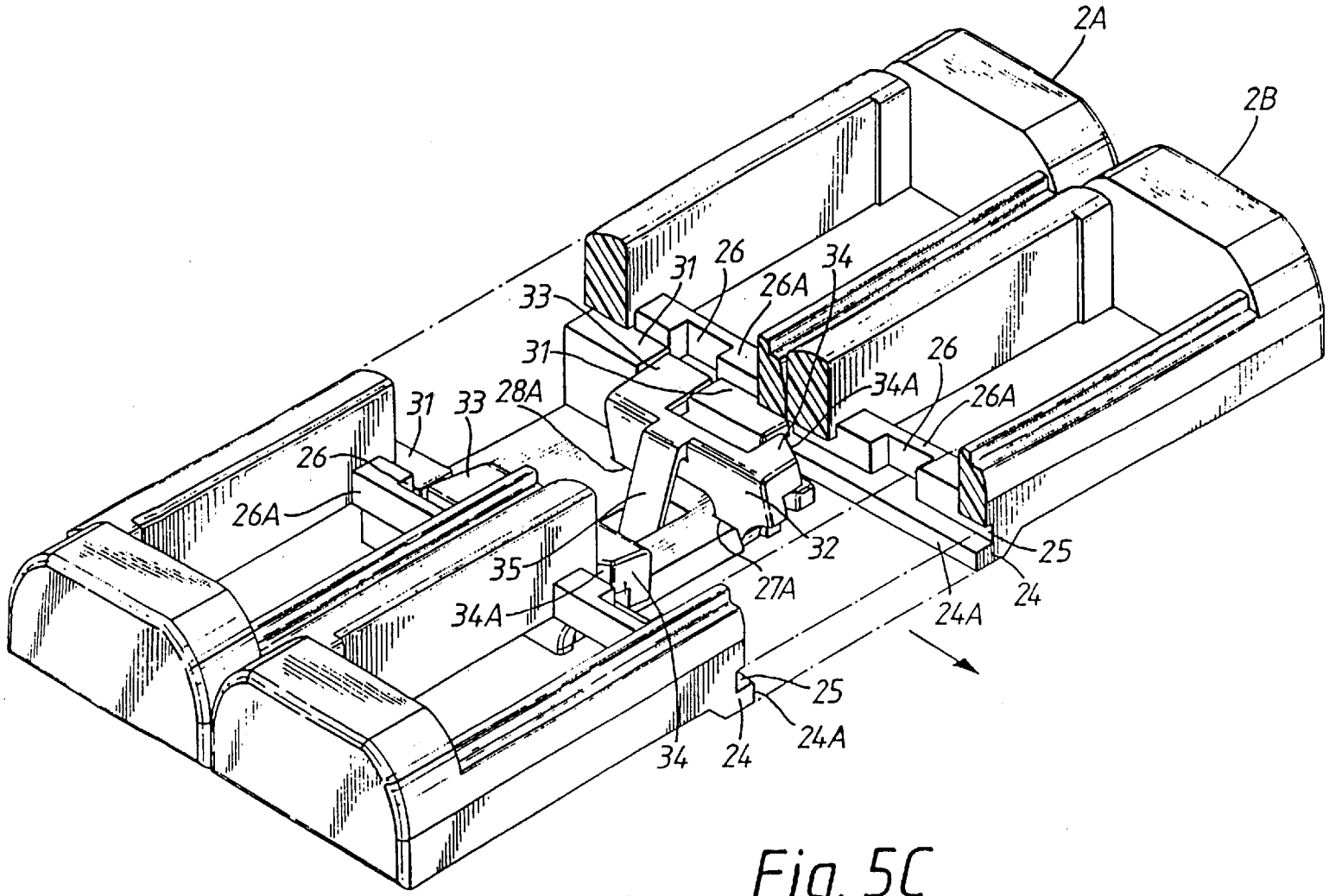
FIG. 5C is a view similar to FIG. 5B but showing two cartridges in juxtaposition to release the handle latch mechanism.

For connection to the razor handle each cartridge has on its rear face a pair of spaced parallel rails 24 extending perpendicular to the length of the cartridge and undercut to define slide grooves 25 (see FIGS. 3 and 4). The head 5 of the handle comprises a slide member 30 (FIG. 5) with a pair of slide elements in the form of laterally directed flanges 31 adapted to slide in the grooves 25 when connecting the cartridges to and disconnecting it from the handle. The cartridge also has a pair of latch slots 26 formed in cross members 26A integral with the cartridge frame and defining the bottom walls of the grooves 25, the latch slots being provided for cooperation with respective latches 32 carried by the slide member 30. The latches 32 have laterally outwardly directed tongues 33 for engagement in the slots 26 and have cams 34 for actuating the latches as described below. The latches are urged apart by a leaf spring 35 formed integrally with the latches. The latches are assembled with the slide member 30 as shown in FIG. 5, the side walls 30A of the channel shaped member 30 having notches 36 for location of the latch tongues and holes 29 for receiving latch retention lugs 37, and the bottom wall 30B having an aperture 38 to accommodate the latch spring 35 and slots 27,28 to receive rearwardly directed location legs 39 provided on the latches. The cams 34 have inclined faces 34A for contacting the inner lateral surfaces 24A (FIGS. 3 and 4) of the rails 24 on a cartridge as the flange 32 slide into the grooves 25. FIG. 5B shows a cartridge in latched attachment with the head of a razor handle, the flanges 31 of the slide member being received in the slide grooves 25 formed by the rails 24, and the latch tongues 33 being engaged in the slots 26. In this condition the cartridge is securely connected to the razor handle. When the cartridge 2A secured to the handle is moved against another substantially identical cartridge 2B, as shown in FIG. 5C, which will happen when the cartridge on the handle is to be replaced by a fresh cartridge from the dispensing container 3 as explained in more detail below, the inclined faces 34A of the cams 34 engage the inner edge surfaces 24A of the rails 24 of the second cartridge 2B causing the latches 32 to be cammed inwardly to retract the latch tongues 32 so that they are withdrawn from the slots 26 of the first cartridge 2A, as illustrated in FIG. 5C. With the latch tongues retracted, they are generally aligned with the flanges 31 and thus are free to pass along the grooves 25. The latches 32 actually pivot to retract the latch tongues, in each case the pivot axis being defined by the front (upper as viewed in FIGS. 5 to 5C) inner edges 27A, 28A of the slots 27,28 against which the location legs 39 rest. Because the slots 28 register with the holes 29 and the sides of the slots 27 diverge rearwardly, the pivotal movement is not impeded by the engagement of the legs 39 in the location slots 27,28. If, from the position shown in FIG. 5C, the handle is moved relative to the cartridges in the direction indicated by the arrow, the cams 34 will slide along the rails 24 of the cartridge 2B holding the latches 32 in their retracted positions until the cams 34 pass beyond the ends of the rails 24 when and the spring 35 will urge the latches outwardly to engage the latch tongues 33 in the latch slots 26 of the cartridge 2B so that this cartridge will become attached securely to the handle for shaving. Of course, when the handle becomes latched to the cartridge 2B it will have been completed detached from the first cartridge 2A. Although just two cartridges are shown in FIG. 5C it will be appreciated that when several cartridges are placed side-by-side in a row, as they are packed into the dispensing container their rails 24 are aligned to define a slideway extending continuously along the row and the handle can slide along the row of cartridges from the last to the first-in the row.

When a cartridge is to be dispensed to replace a used cartridge on the handle 1, the used cartridge still securely latched to the handle, is inserted into the entry position in the container 3, e.g. as indicated at the right hand side of FIG. 1, and it is moved by means of the handle to bring it into abutment with the trailing cartridge in the row of cartridges housed in the container and then to move the row of cartridges along the container to bring the leading cartridge to the dispense position. When further advancement of the row of cartridges is arrested by abutment of the leading cartridge with the exit end wall 12 of the container, continued movement of the handle and the used cartridge thereon causes the latches 32 to be actuated to disengage the tongues 33 from the latch slots 26 by the latch cams 34 coacting with the rails 24 of the cartridge immediately in front (as indicated at the left-hand side of FIG. 6). With the latches thus released, the head of the handle is free to slide along the slideway defined by the row of cartridges, the latches being maintained in the unlatched condition due to the cooperation of the cams with the cartridge rails 24, as illustrated by the medial portions of FIGS. 1 and 6. When the handle reaches the leading cartridge at the dispense position and the cams 34 pass beyond the rails of this cartridge, the latches 32 under the influence of the spring 35 are actuated to engage the latch tongues 33 in the latch slots 26 of the cartridge, thereby connecting the cartridge securely to the handle so that it can be withdrawn from the container, as shown at the left-hand side of FIG. 1 and the right-hand end of FIG. 6. It may be noted that the end wall of the container is provided with a recess 14 so as not to interfere with the cams 34. The cartridges supplied in the container are dispensed in turn by repeating the cartridge replacement operation, as just described. For the user the cartridge replacement operation is simple to complete and requires a single stroke of the handle to insert the used cartridge, move the handle along the container, and finally remove the new cartridge.

Figure 6:
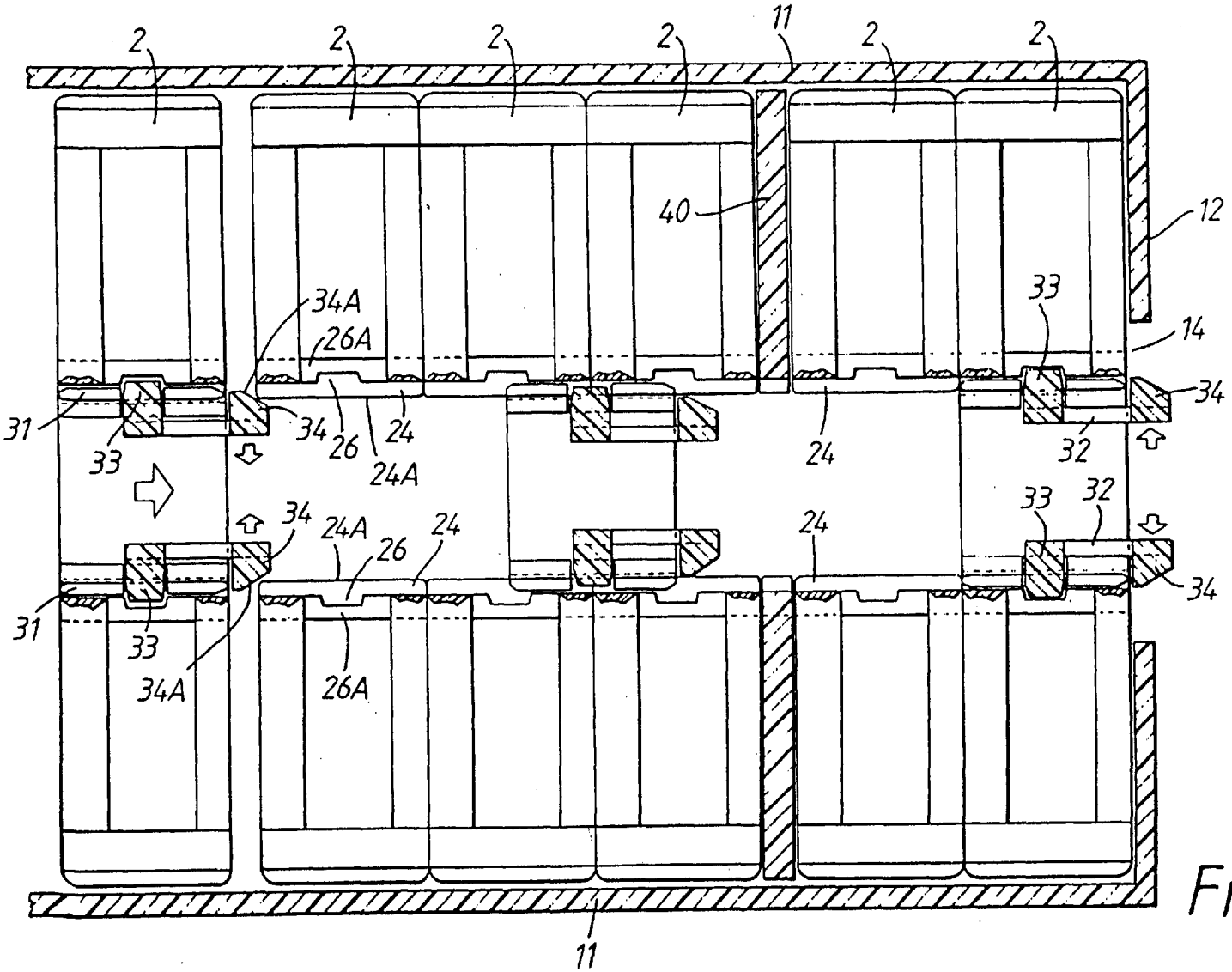
FIG. 6 is a longitudinal horizontal section illustrating operation of a blade unit latch mechanism during a blade unit replacement operation.
Figure 7A:
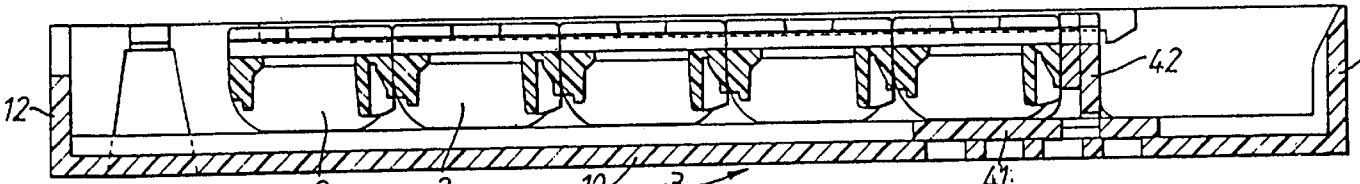
FIGS. 7A and 7B illustrate the dispensing container in longitudinal vertical cross section and showing the blade units positioned at successive stages during dispensing the first blade unit.
Figure 7B:
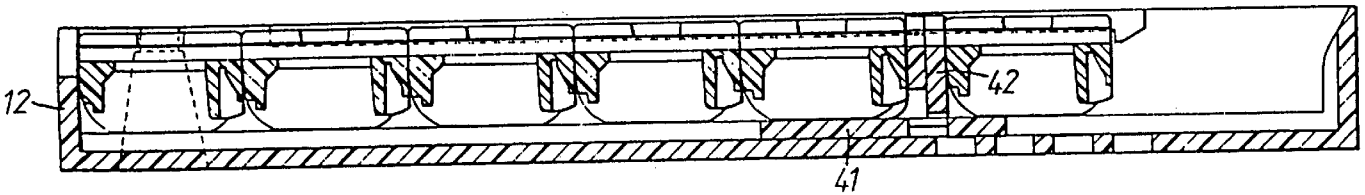
Figure 8A:
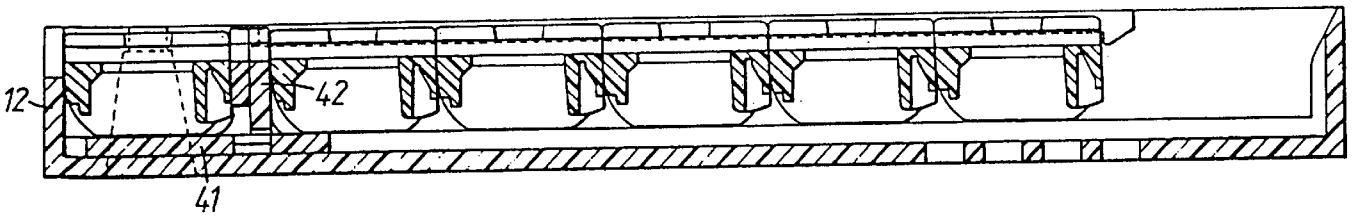
FIGS. 8A and 8B illustrate the dispensing container at successive stages during dispensing the last of the unused blade units supplied in the container.
Figure 8B:
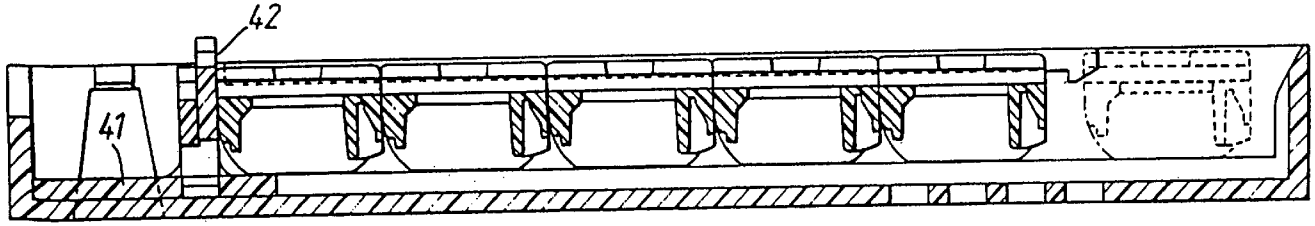

A barrier member 40, e.g. as shown schematically in FIG. 6, may be included to prevent used cartridges being dispensed after all the unused cartridges have been dispensed from the container. This barrier member is shaped in its upper portion to provide a smooth continuity of the slideway defined by the cartridge rails 24, at least until the last of the new cartridges has been dispensed. A particular form of barrier and its operation are shown in FIGS. 7 and 8. The barrier includes a slide 41 which is received in and slidable along a recess in the upper surface of the bottom wall, and a stop element 42 carried by the slide and biased upwardly by a spring, e.g. formed integrally with the stop element. When the dispenser is filled with new cartridges (FIG. 7A) the barrier is positioned behind the trailing cartridge, but beneath the container flanges 15 which hold the stop element down. Thus, when the first used cartridge is inserted it pushes against the barrier rather than the trailing cartridge (FIG. 7B) although the dispensing operation is still carried out essentially as described above. During successive dispensing operations the barrier advances along the container with the cartridges. When the last of the new cartridges is pushed into the dispense position (FIG. 8A) and withdrawn, the stop element 42 is disposed adjacent the forward end of the container flanges 15. If attempt is made to dispense another cartridge, the slide 41 is pushed against the end wall 12, and the stop element 42 clears the flanges 15 and is projected upwardly by its spring to block the end of the slideway defined by the rails 24 of the enclosed used cartridges 2. The stop element 42 prevents the razor handle reaching the dispense position and constrains the user to reverse the handle along the container and pick up again the used cartridge just inserted. Of course, other forms of barrier are possible and will occur to skilled readers.

Figure 13:
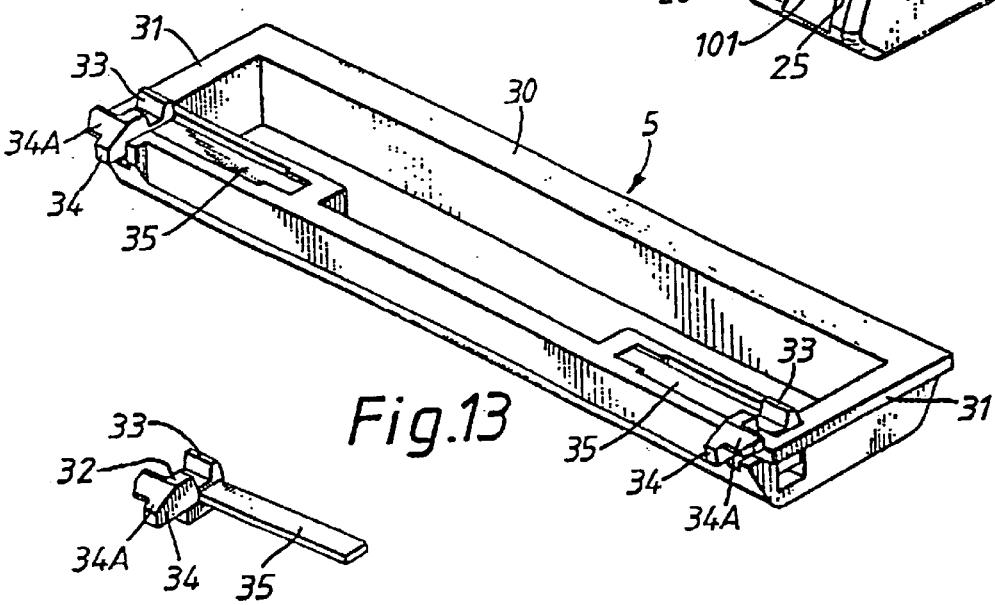
FIG. 13 is a front perspective view of the blade unit coupling arrangement of the razor handle of the FIG. 10A system.
Figure 14:
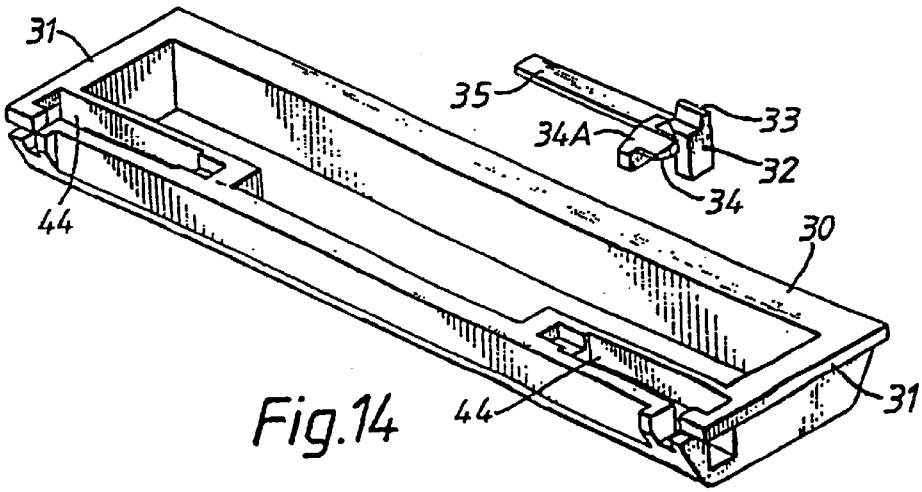
FIG. 14 is an exploded view of the arrangement shown in FIG. 13.
Figures 15A, 15B, 16A, 16B:
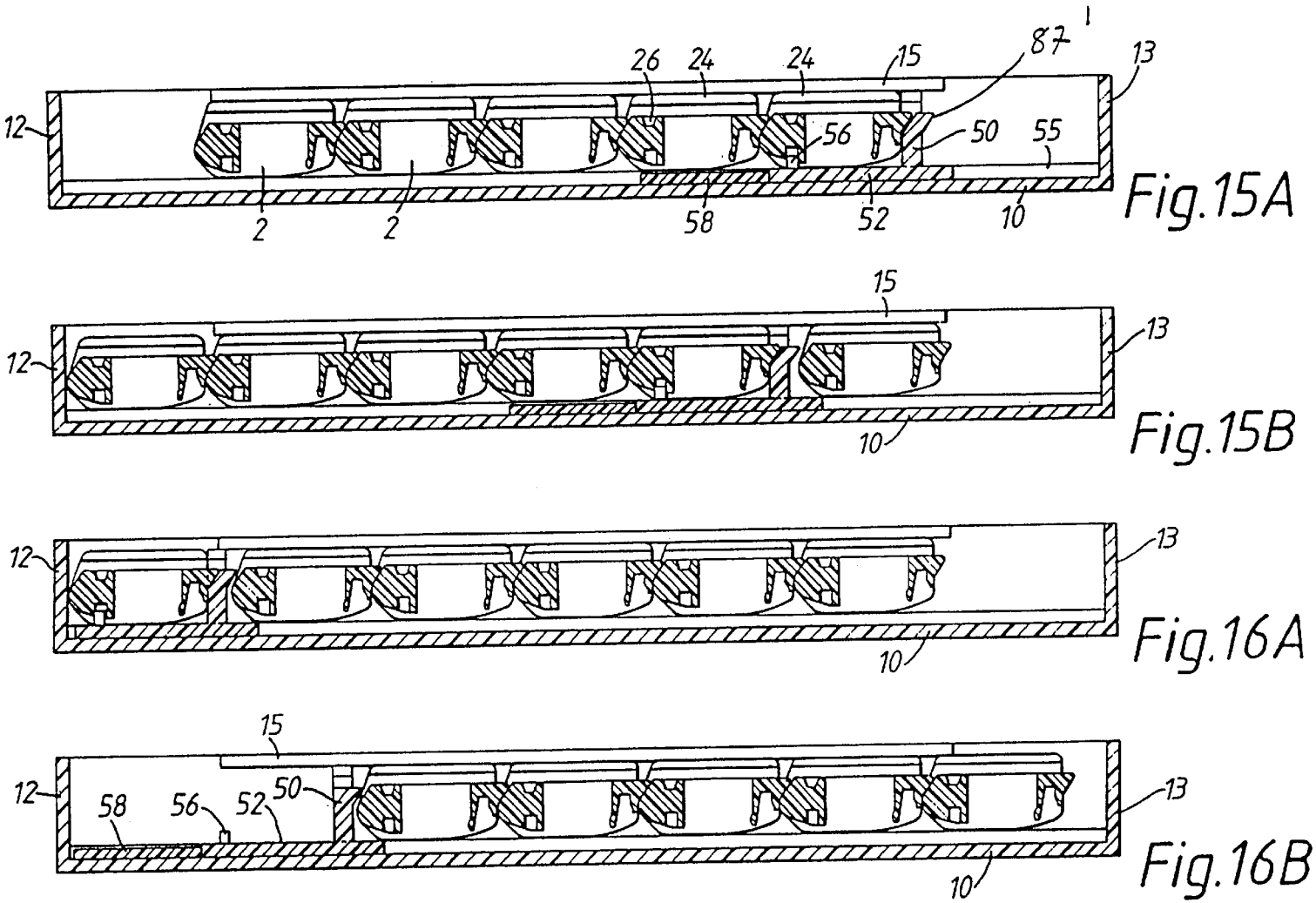
FIGS. 15A, 15B, 16A and 16B are views corresponding to FIGS. 7A, 7B, 8A and 8B respectively but showing the dispensing container of the FIG. 10A system.
Figure 17:
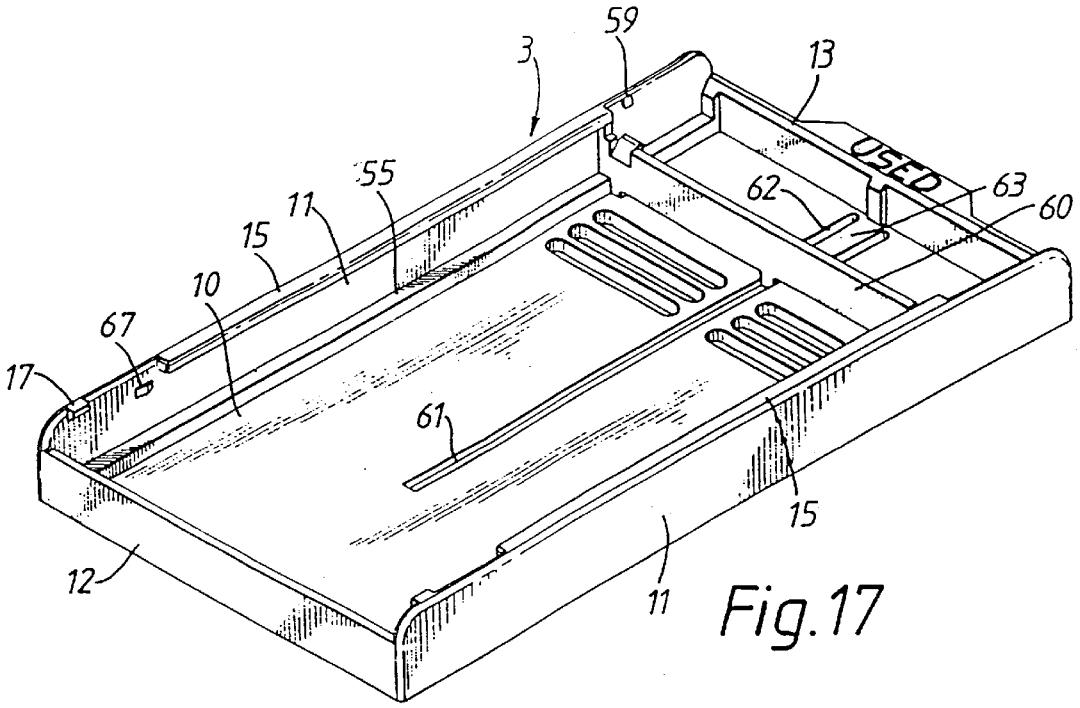
FIG. 17 is a perspective view showing an alternative form of dispensing container.
Figure 18:
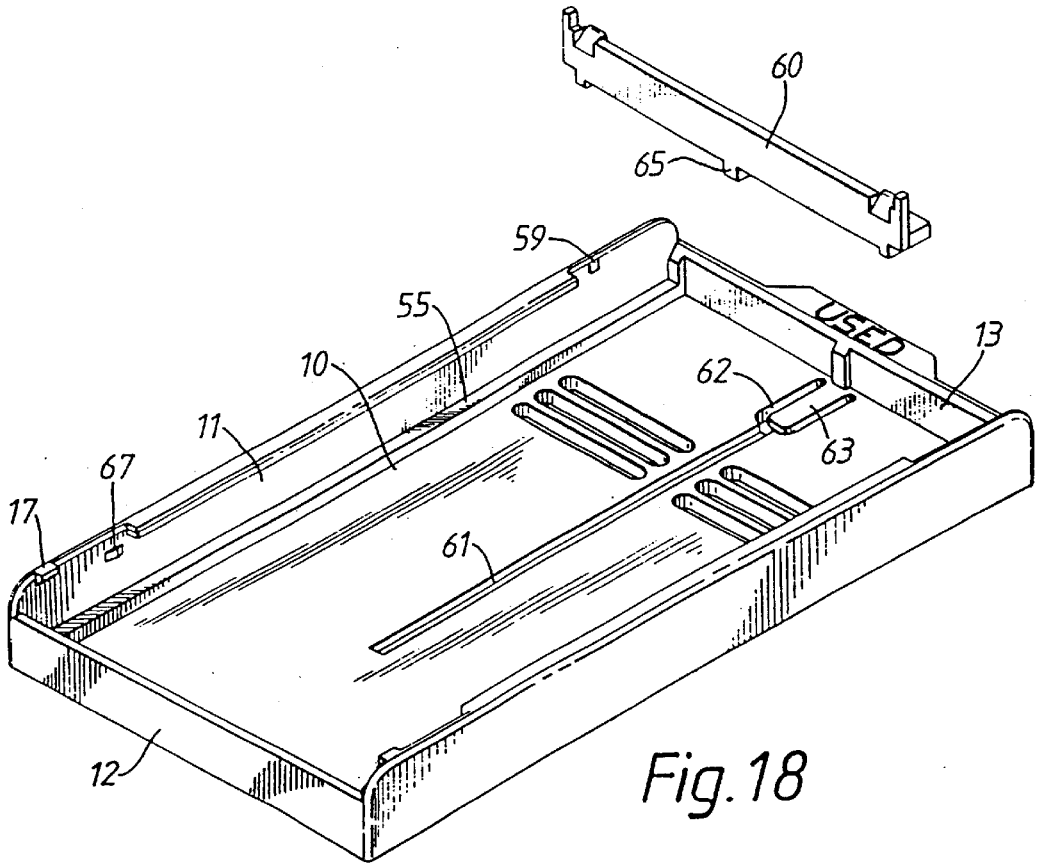
FIG. 18 is an exploded perspective view of the dispensing container shown in FIG. 17.

The embodiment of the invention shown in FIGS. 10 to 16 is basically similar to that described above and the same reference numerals have been used in the drawings to designate corresponding parts of the respective embodiments. The rails 24 are located at the extreme ends of the cartridge 2 (FIG. 12) and the latch slots 26 open rearwardly. In the elongate edge of the cartridge frame adjacent the latch slots 26, forwardly tapering recesses 101 are provided, and complementary toothlike protrusions 102 are provided on the opposite longitudinal edge so that two cartridges can be positioned alongside each other, as may be seen in FIGS. 10B and 10C, with the protrusions 102 of one cartridge nesting in the recesses 101 of the adjacent cartridge so that continuous slide surfaces are define across the rear of the adjacent cartridges by the rear surface portions 104. The head 5 of the handle (FIGS. 13 and 14) comprises member 30 with end flanges 31, and separate latches 32 accommodated in recesses 44 provided in the head member 30. The latches are provided with respective leaf springs 35 for urging the latch tongues 33 forwardly (upwardly as seen in FIGS. 13 and 14) to engage the latch slots 26. The latch cams 34 protrude forwardly and have inclined faces 34A for cooperation with slide surfaces of the cartridge in which the latch slots 26 are provided. The operation of the sliding and latch mechanism is very similar to the previous embodiment except that the latches operate vertically instead of horizontally. Thus, when a used cartridge is introduced at the entry position of the dispenser container and moved forwardly, the cartridges in the container are pushed along the container, following which the latches are disengaged by virtue of the cams 34 engaging the cartridge (or barrier 40) immediately in front, and the handle slides along the continuous slideway defined by the rails 24 of the cartridges (see FIG. 10A) until it reaches and latches onto the leading cartridge in the dispense position. During this sliding motion, the cams 34 slide along the continuous surface defined by the rear surface portions 104 of the abutting cartridges, thereby maintaining the latches in a disengaged piston.

Figure 10B:
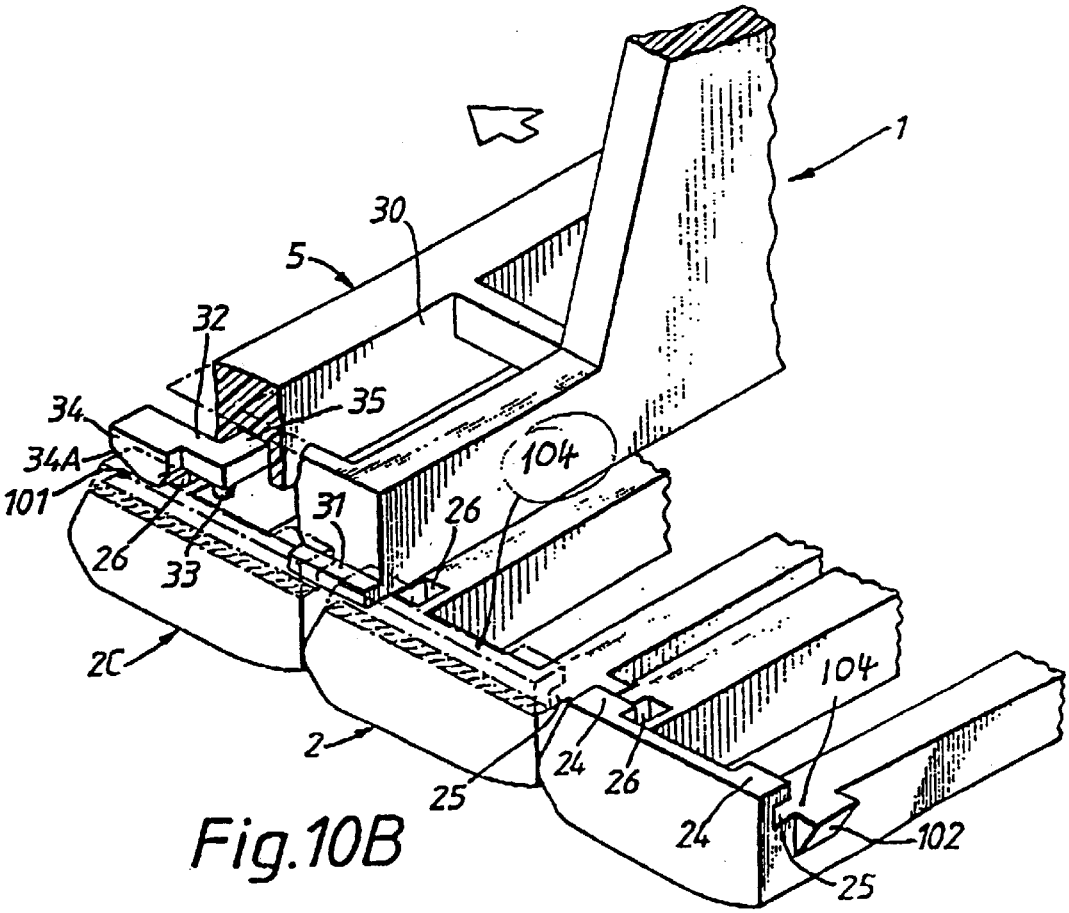
FIGS. 10B and 10C are partially cut away schematic perspective views illustrating the final stage of movement of the razor handle into latching engagement with the leading cartridge in the system of FIG. 10A.
Figure 10A:
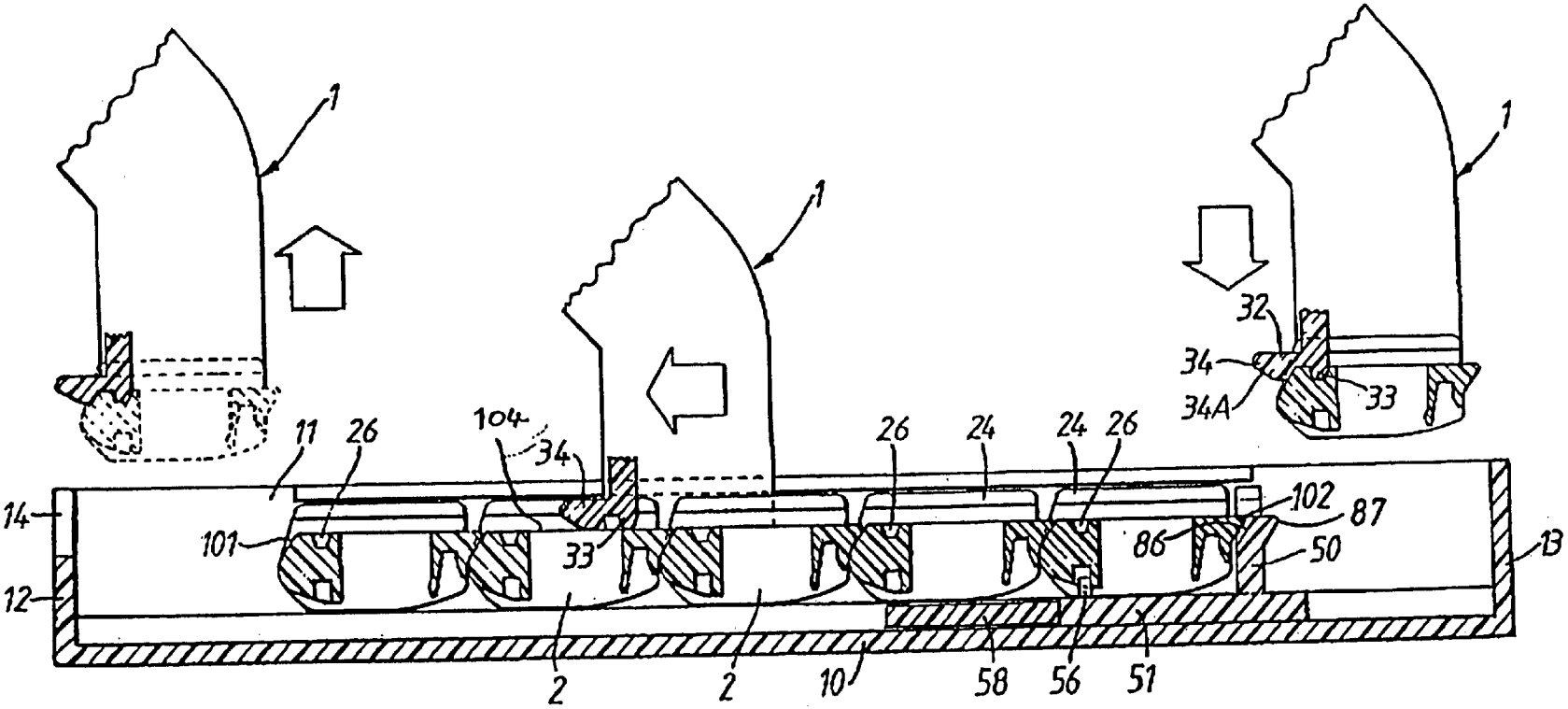
FIG. 10A is a cross-sectional view similar to FIG. 1 and illustrating another embodiment of a shaving system according to the invention.
Figure 10C:
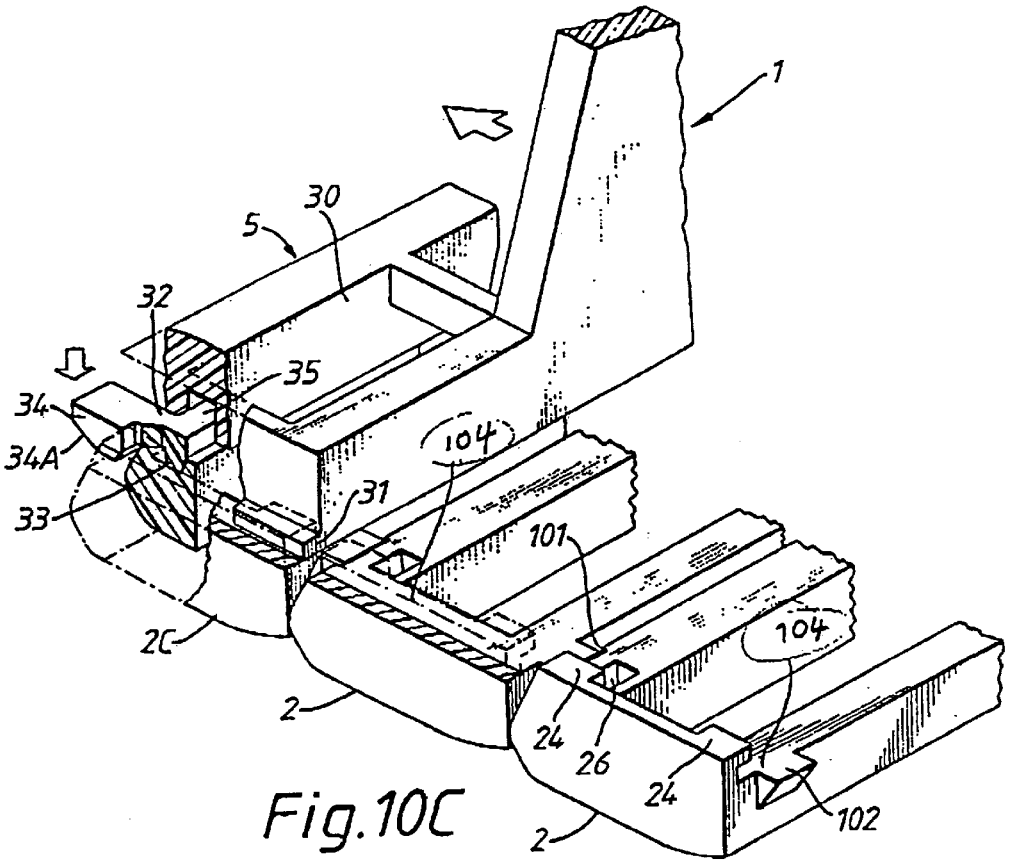
Figure 11:
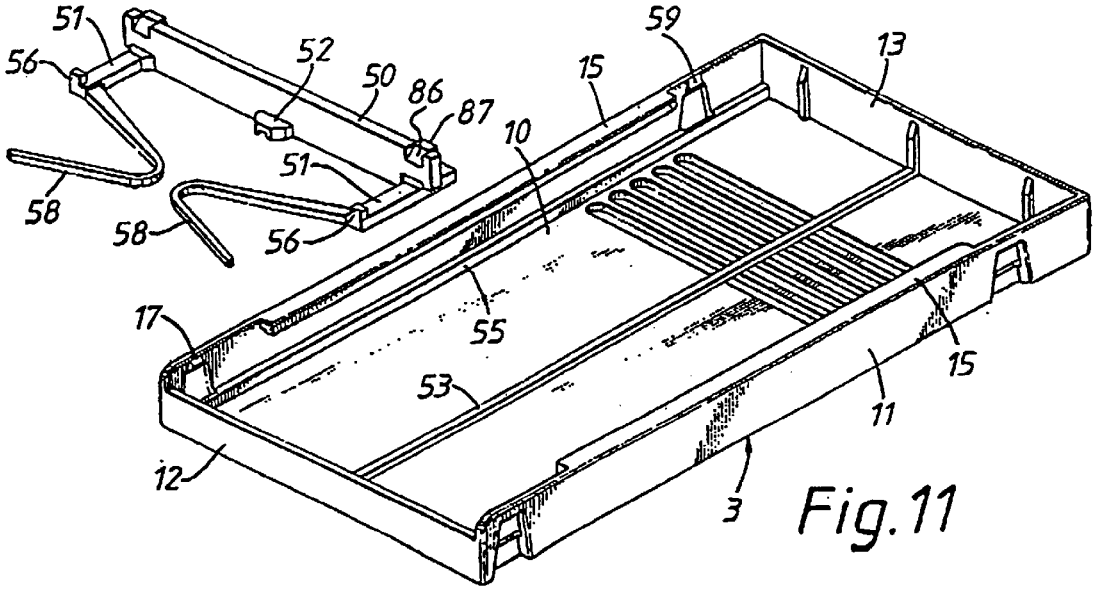
FIG. 11 is an exploded perspective view of the dispenser container of the system of FIG. 10A.
Figure 12:
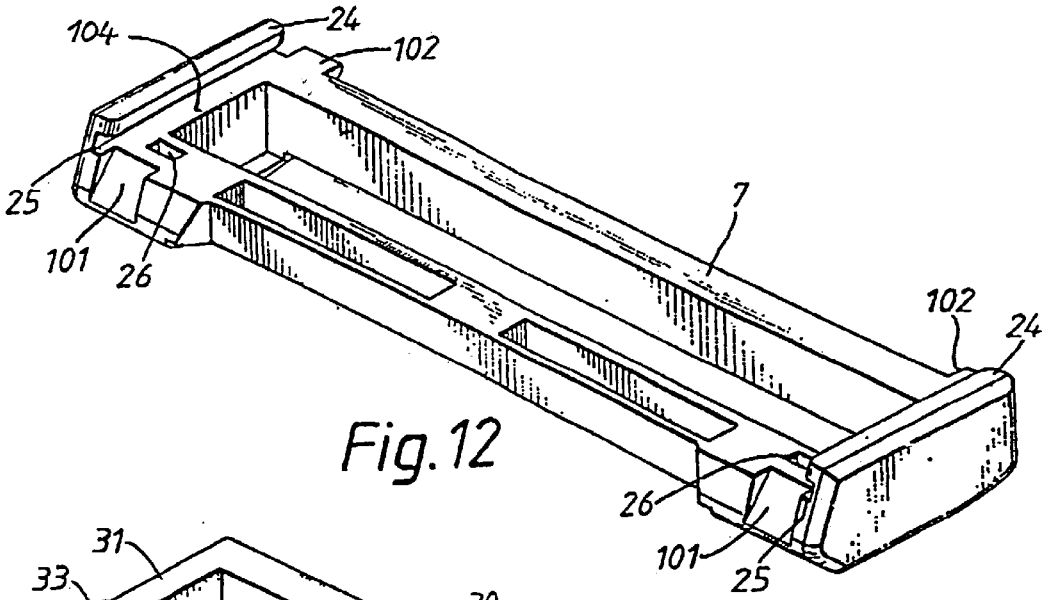
FIG. 12 is a rear perspective view of a blade unit of the FIG. 10A system.

The final stages of the handle sliding into latching engagement with the leading cartridge are illustrated in FIGS. 10B and 10C. The latch projections, which need not he tongues and can take other shapes such as the pegs 33 shown in FIGS. 10B and 10C, are held retracted against the resiliency of the latch springs 35 due to the cams bearing against the confronting rear slide surface portions 104 of the leading cartridge 2C, as shown in FIG. 10B, until the cams pass beyond these surfaces and under the bias of the springs 35 drop into the recesses 101 provided in the adjacent edge of the cartridge, as shown in FIG. 10C. The resulting displacement of the latches 32 causes the latch projections 33 to enter the latch slots 26 of the cartridge whereby the handle becomes locked against further movement relative to the cartridge 2C. As mentioned above, the protrusions 102 and recesses 101 of adjacent cartridges in the dispenser container cooperate so that the abutting cartridges combine further rear surface portions 104 to define continuous slide paths for the cams 34 of the latches 32.

It may be noted that in this embodiment it is not essential for the slide rails to extend continuously across the cartridges and interruptions may be provided, e.g. for ease of manufacture, so long as the rails provide adequate guidance for the sliding movement of the razor handle head during cartridge replacement operations such interruptions in the rails are depicted in FIGS. 10B and 10C.

An improved form of barrier is incorporated in the container of the embodiment of FIGS. 10–16. It includes an upright slide 50 which has notches 86 and projections 87 of corresponding to those of the cartridges and which is guided for sliding movement along the bottom wall of the container by a pair of feet 51, and a central block 52 which seats on a rib 53 running along the centre of the bottom wall of the container. The cartridges slide along rails 55 formed in the container along its lateral edges, and the last cartridge sits over the slide and is constrained to move therewith by pegs 56 on the slide feet which project upwardly into holes in the cartridge frame. Integral with the feet 51 are U-shaped spring elements 58 which are initially unstressed and as indicated by FIGS. 15A and 15B remain unstressed until the cartridge seated over the slide is next to be dispensed. When this cartridge is advanced into the dispense position the spring elements 58 are compressed by the end wall 12 (FIG. 16A), and after this cartridge is withdrawn from the container by the handle 1 to which it is securely latched, the spring elements expand again and push back the barrier slide 50 and the cartridges disposed behind it so that the last inserted cartridge occupies the entry position to thwart any attempt to insert a further cartridge into the container. In order to retain the cartridge in the entry position the container is provided with small protrusions 59 (FIG. 11) similar to those projections 17 provided for similar purpose at the dispense location.

Rather than having a spring stressed by compression against the end wall, the barrier slide could be equipped with a spring which is held in a precompressed condition and automatically released for expansion upon the slide approaching the end wall 12, for moving the barrier slide and cartridges back as described above.

Figure 19:
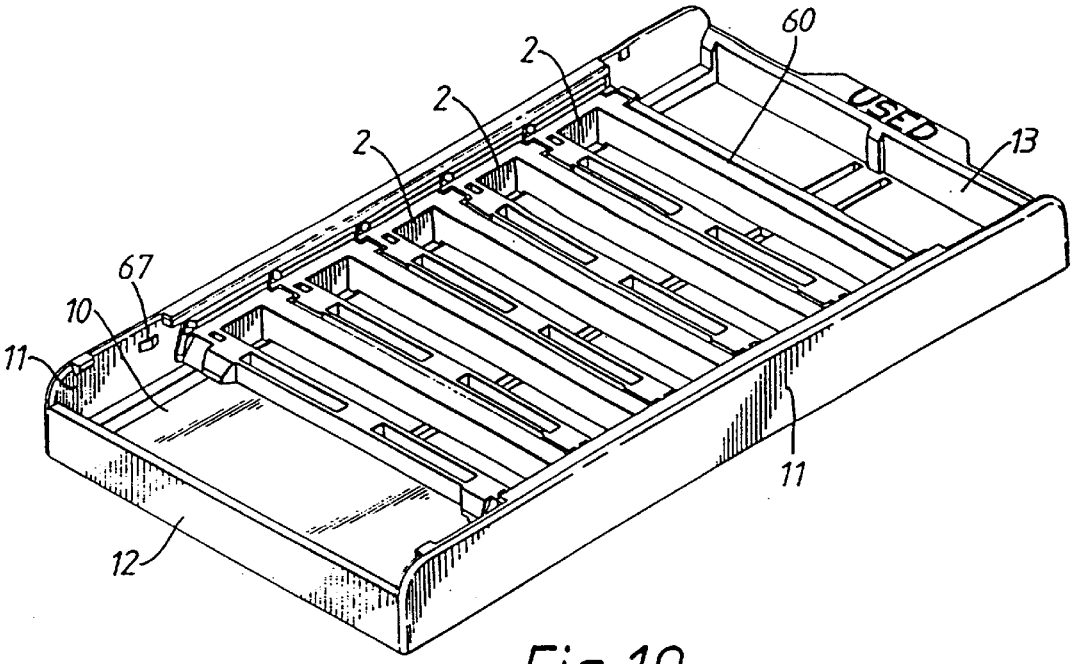
FIG. 19 is a view similar to FIG. 17 and showing the container filled with blade units.
Figure 22:
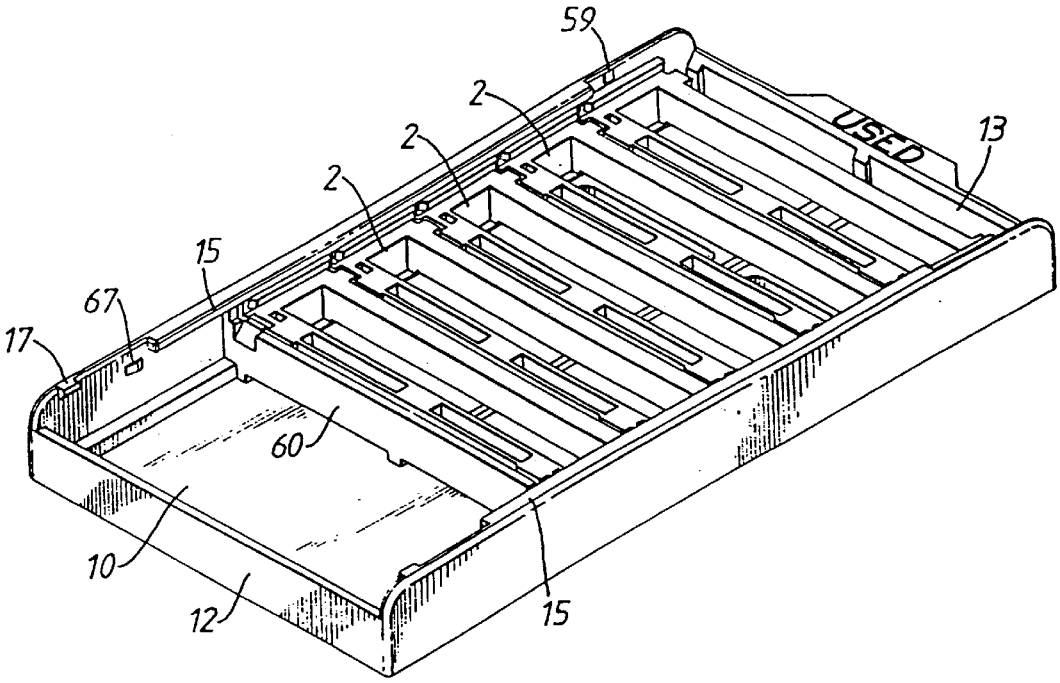
FIG. 22 is a perspective view showing the dispensing container after all the new blade units have been dispensed and replaced by used blade units.
Figures 20A, 20B, 21A, 21B:
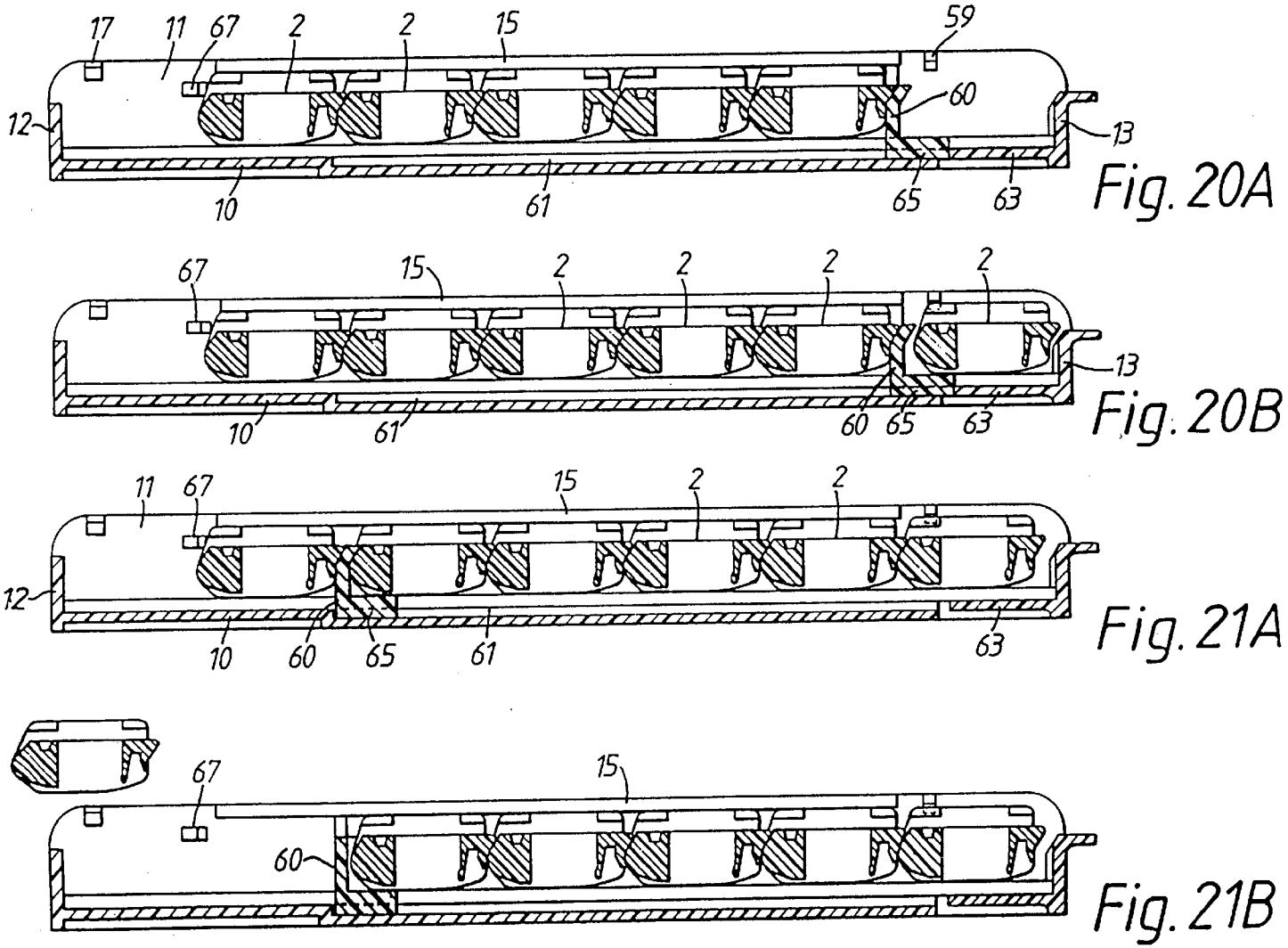
FIGS. 20A, 20B, 21A, 21B are corresponding longitudinal sections illustrating the dispensing container of FIGS. 17 to 19 during different stages of dispensing the blade units therein.

Another embodiment of a dispensing container for use with cartridges 2 and a razor handle as described with reference to FIGS. 10 to 16 is illustrated in FIGS. 17 to 22. The container 3, like the embodiment of FIG. 11, has the general form of an open-topped tray with a bottom wall 10, end walls 12,13 at the cartridge exit and entry ends, and side walls 11 with inwardly directed flanges 15 for retaining the cartridges in the container. Also, lateral slide rails 55 are provided for the cartridges and detents 17,59 are provided and project inwardly on the side walls at the dispense and entry positions for retaining cartridges when they are located in these positions and hence not retained by the flanges 15. The dispenser has a different form of barrier 60 however. The bottom wall of the container includes a barrier guide track defined by a longitudinal channel 61 which ends short of the exit end wall 12 as explained below. At the entry end the channel 61 opens into a U-shaped slot 62 defining a resilient tongue 63 which acts as a rear stop for the barrier but can be deflected downwardly to enable the barrier to engage with the guide channel and enter beneath the container flanges 15. The barrier 60 consists of an L-shaped slide member with a downwardly projecting rib 65 for sliding engagement in the channel 61. During assembly the barrier member 60 is inserted into the container 3 at the entry end, the rib 65 causing the tongue 63 to deflect downwardly. The barrier is then moved forwardly to engage beneath the container flanges 15 whereupon the tongue 63 snaps back behind the rib 65 to prevent the barrier being moved back out of the container. The barrier is shown inserted in FIGS. 17 and 19, but in the former the cartridges have been omitted to facilitate illustration of the barrier. The new cartridges will be loaded into the container before the barrier, although the container could be adapted to allow them to be loaded subsequently through the exit end. FIGS. 19 and 20A show the container as supplied to a consumer loaded with five new cartridges. When a used cartridge on the razor handle (not shown) is to be replaced by one of the new cartridges, the used cartridge is inserted in the entry position (FIG. 20B) and is moved forwardly to displace the barrier 60 and new cartridges along the container to bring the leading cartridge into the dispense position. The handle then unlatches from the used cartridge and slides along until it latches onto the new cartridge in the dispense position and this new cartridge is withdrawn from the container on the handle. The next three new cartridges are dispensed in turn in essentially the same manner. However, when the penultimate blade unit has been dispensed, i.e. all but the last new cartridge have been dispensed, the barrier 60 will have been advanced to the front end of the guide channel 61 and further movement of the barrier along the container is blocked. When the last new cartridge is to be dispensed, the used cartridge being replaced is inserted at the entry position (FIG. 21A) as before, but the cartridges in front of it cannot be displaced along the container because forward movement of the barrier 60 is blocked. Therefore the handle immediately unlatches the used cartridge leaving it occupying the entry position. The handle slides along the cartridges in the dispenser until it latches onto the remaining unused cartridge, pulls this cartridge into the dispense position and then removes it from the dispenser (FIG. 21B). The container is then left filled with used cartridges and the last used cartridge is located at the entry position to give a clear indication that all the new cartridges have been used up and precluded any attempt to dispense another cartridge, as shown in FIG. 22.

It may be noted that in the embodiment of FIGS. 17 to 22, the container is provided with additional side wall detents 67 to prevent the leading cartridge inadvertently slipping forwards into the dispense position so that this cartridge is kept under the retention flanges 15 until it is to be dispensed.

Modifications to the shaving system herein described are possible without departing from the inventive concepts as defined by the following claims, the specific embodiments having been given by way of non-limiting example only.

I claim:

1. A shaving system comprising a razor handle for detachably mounting a blade unit, a dispensing container and a plurality of blade units housed side-by-side in a row between entry and exit ends of the container, the container comprising a bottom and side walls with inwardly projecting retaining flange means arranged to overlie a portion of the blade units housed between the entry and exit positions for retaining said blade units in the container, the flange means defining an opening in the container through which the handle can project, said blade units comprising means, including a plurality of rails that define a substantially continuous slideway along the blade units, for guiding a head of the handle longitudinally within the container during blade unit replacement with a portion of the head disposed beneath the flange means and with a bottom portion of the handle projecting through the opening, whereby to permit the handle to be guided longitudinally of the container during blade unit replacement for leaving a blade unit initially thereon at a trailing end of the row and for engaging and withdrawing from the container a leading blade unit, said rails projecting from rear faces of the blade units that face the handle and extending perpendicular to respective lengths of the blade units.

2. A shaving system according to claim 1, wherein the container defines normally vacant entry and dispense positions adjacent the entry and exit ends thereof, and the leading blade unit of a row of cartridges housed in the container between the entry and dispense positions is advanced into the dispense position by a further blade unit carried by the handle being inserted into the entry position and moved towards the exit end of the container to displace the blade units in unison along the container.

3. A shaving system according to claim 1, wherein the container includes barrier means movable along the container with the blade units from a position initially behind the blade units to prevent used blade units inserted into the container behind the barrier means being dispensed from the exit end of the container, the barrier means providing a smooth continuity of the guiding means provided on blade units located on either side of the barrier means.

4. A shaving system according to claim 3, wherein means are provided for controlling displacement of the barrier means and following blade units upon dispensing the final unused blade unit to cause the last used blade unit inserted to block insertion of a further blade unit at the entry end.

5. A razor blade unit dispensing container for housing a plurality of unused blade units to be dispensed in turn and for receiving a used blade unit for each unused blade unit dispensed, the container comprising (a) a normally vacant entry portion for insertion of a used blade unit at one end of the container, (b) a dispense portion for removal of an unused blade unit at an opposite end of the container, the blade units accommodated in the container being advanced in unison along the container as the unused blade units arc dispensed, (c) a bottom, (d) side walls with inwardly projecting retaining flange means arranged to overlie a portion of the blade units housed between the entry and dispense portions for retaining said blade units in the container without blocking removal of a blade unit from the dispense portion away from the bottom of the container in a direction perpendicular to the bottom; and without blocking insertion of a blade unit into the entry portion toward the bottom of the container in a direction perpendicular to the bottom; (e) first end wall means at the dispense portion of the container cooperating with the bottom and side walls to prevent withdrawal of a blade unit from the dispense portion other than away from the bottom of the container in a direction perpendicular to the bottom; (f) a barrier member slidable in the container for movement with the blade units and arranged to separate unused blade units from used blade units and to prevent used blade units from advancing into the dispense portion, said barrier member comprising spring means, including feet on which a final unused blade unit slides and a spring projecting from the feet toward the dispense portions for urging the barrier member rearwardly toward the entry portion upon the final unused blade unit being dispensed; and (g) second end wall means at the entry portion of the container cooperating with the bottom and side walls for preventing insertion of a blade unit into the entry portion other than toward the bottom of the container in a direction perpendicular to the bottom.

6. A dispensing container according to claim 5, wherein the spring means are stressed by movement of the barrier member towards an end of the container during advancement of the final unused blade unit to the dispense position.

7. A razor blade unit dispensing container according to claim 5 further comprising first detent means for retaining a blade unit in the entry portion.

8. A razor blade unit dispensing container according to claim 7 further comprising second detent means for retaining a blade unit in the dispensing portion.

9. A razor blade unit dispensing container according to claim 5 further comprising projecting means for preventing a blade unit that has advanced from the entry portion toward the dispense portion from returning to the entry portion.

10. A razor blade unit dispensing container according to claim 5 further comprising side wall detent means for preventing a blade unit from slipping into the dispense portion.

* * * * *